US007082629B2

(12) United States Patent
Clark

(10) Patent No.: US 7,082,629 B2
(45) Date of Patent: Aug. 1, 2006

(54) KNOCK-DOWN HAMMOCK STAND

(75) Inventor: Walter George Clark, Washington, NC (US)

(73) Assignee: Hatteras Hammocks, Inc., Greenville, NC (US)

( * ) Notice: Subject to any disclaimer, the term of this patent is extended or adjusted under 35 U.S.C. 154(b) by 141 days.

(21) Appl. No.: 10/855,457

(22) Filed: May 28, 2004

(65) Prior Publication Data

US 2005/0262631 A1 Dec. 1, 2005

(51) Int. Cl.
*A45F 3/24* (2006.01)

(52) U.S. Cl. ..... 5/127; 5/129

(58) Field of Classification Search ..... 5/127, 5/129, 120
See application file for complete search history.

(56) References Cited

U.S. PATENT DOCUMENTS

| | | | | |
|---|---|---|---|---|
| 944,661 | A * | 12/1909 | Buck | 5/129 |
| 950,070 | A * | 2/1910 | Funke | 5/129 |
| 972,783 | A * | 10/1910 | McBride | 5/128 |
| 2,469,950 | A * | 5/1949 | Carl | 5/129 |
| 4,925,138 | A * | 5/1990 | Rawlins | 248/165 |
| 4,951,332 | A * | 8/1990 | Barmettler | 5/120 |
| 5,113,538 | A * | 5/1992 | Branch, III | 5/127 |
| 5,297,302 | A * | 3/1994 | Anderson | 5/127 |
| 5,392,476 | A * | 2/1995 | Williams | 5/127 |
| 5,636,392 | A * | 6/1997 | Choi | 5/127 |
| 5,729,845 | A * | 3/1998 | Hsu | 5/120 |
| 6,360,383 | B1 * | 3/2002 | Tseng | 5/129 |
| 6,470,518 | B1 * | 10/2002 | Ke | 5/120 |
| 6,711,764 | B1 * | 3/2004 | Mauze, Jr. | 5/127 |
| 6,851,138 | B1 * | 2/2005 | Wilson | 5/120 |
| 6,931,679 | B1 * | 8/2005 | Tseng | 5/127 |
| 2002/0166171 | A1 * | 11/2002 | Ke | 5/121 |
| 2005/0262631 | A1 * | 12/2005 | Clark | 5/127 |

* cited by examiner

*Primary Examiner*—Robert G. Santos

(57) ABSTRACT

A hammock stand is described that can be assembled from a plurality of tubular members. The tubular members are of similar dimensions and to some extent interchangeable. This allows the stand, in disassembled form to be contained in a relatively small box for shipping and storage.

1 Claim, 4 Drawing Sheets

KNOCK-DOWN HAMMOCK STAND

FIELD OF THE INVENTION

This invention is directed to a hammock stand that is assembled from a plurality of tubular members which are similar in dimension and to some extent interchangeable.

BACKGROUND OF THE INVENTION

Hammocks are an ever popular form of outdoor, leisure furniture. Hammock stands are a convenient means of supporting a hammock, since they are readily mobile (as contrasted to trees or posts). But one problem with hammock stands, is their bulk; they are quite large because they need to extend substantially beyond each end of the hammock and have lateral foot supports that extend to or beyond the sides of the hammock.

In commerce this bulk is a particular problem, because manufacturers and merchants making and selling hammock stands require large containers to package them and considerable space to store them.

It is, accordingly, an object of the present invention to provide an improved hammock stand comprised of a plurality of tubular members similar in dimension, which can be disassembled for storage or shipment in a relatively small container. Other objects and advantages will be apparent to one skilled in the art, and are inherent in the spirit of the invention as expressed in the appended claims.

DISCLOSURE OF THE PRIOR ART

Applicant is aware of no prior art directly relevant to the present invention.

Description of a conventional hammock stand can be seen in such prior art as U.S. Pat. No. 5,153,538.

SUMMARY OF THE INVENTION

In accordance with the present invention, a hammock stand is formed of six interconnected poles, two of which comprise a base member and four of which comprise upwardly extending members on opposite ends of the base member. The base member and upwardly extending members are joined by an elbow joint which is permanently attached to laterally extending foot members.

DETAILED DESCRIPTION OF THE DRAWINGS

Reference will now be made to the present preferred embodiment of the invention as illustrated in the accompanying drawings.

Figure 1:
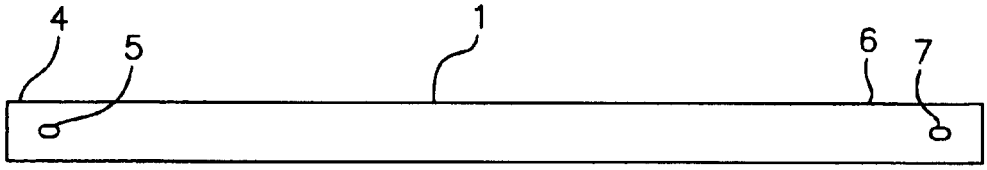
FIG. 1 is a top plan view of the straight pole
Figure 2:
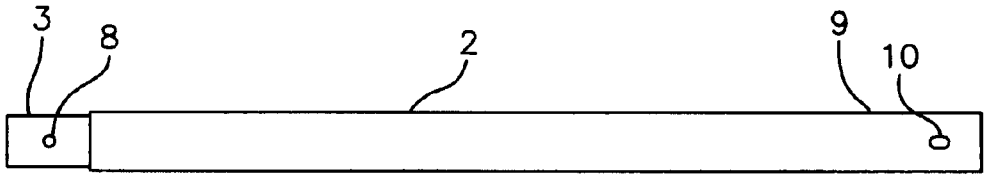
FIG. 2 is a top plan view of the swaged pole

FIG. 1 and FIG. 2 illustrate the two aluminum tubular members which constitute the basic components of the hammock stand.

The straight pole 1 has opposite end portions 4 and 6. An aperture 5 is formed through one wall of the end portion 4. An aperture 7 is formed through one wall of end portion 6.

The swaged pole 2 has opposite end portions 3 and 9. An aperture 10 is formed through one wall of end portion 9. End portion 3 is circumferentially reduced, so that its outer diameter is slightly less than inner diameter of end portion 6. A spring button 8 extends upwardly through one wall of end portion 3. When end portion 3 is inserted into end portion 6, the spring button 8 aligns with and engages the aperture 7.

Figure 3:
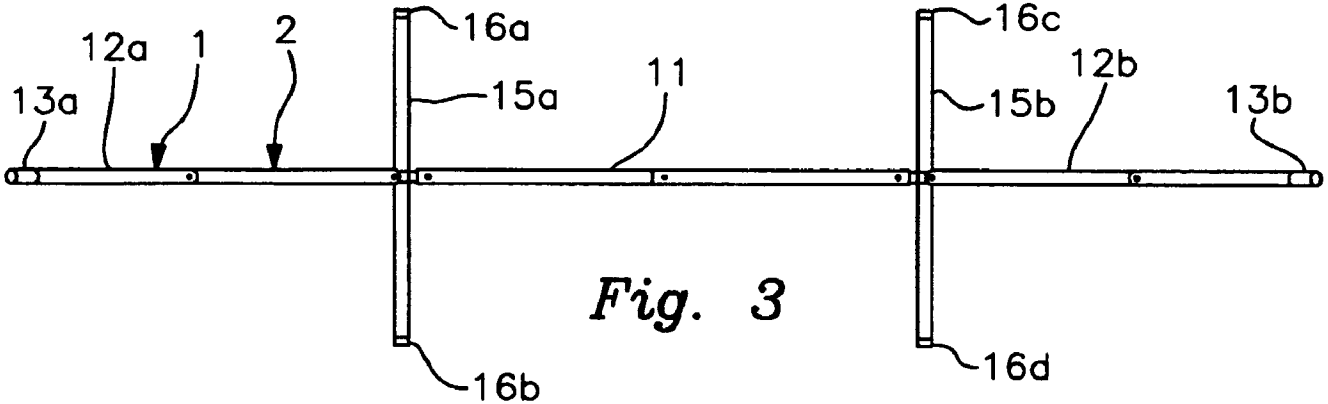
FIG. 3 is a top plan view of the assembled stand
Figure 4:
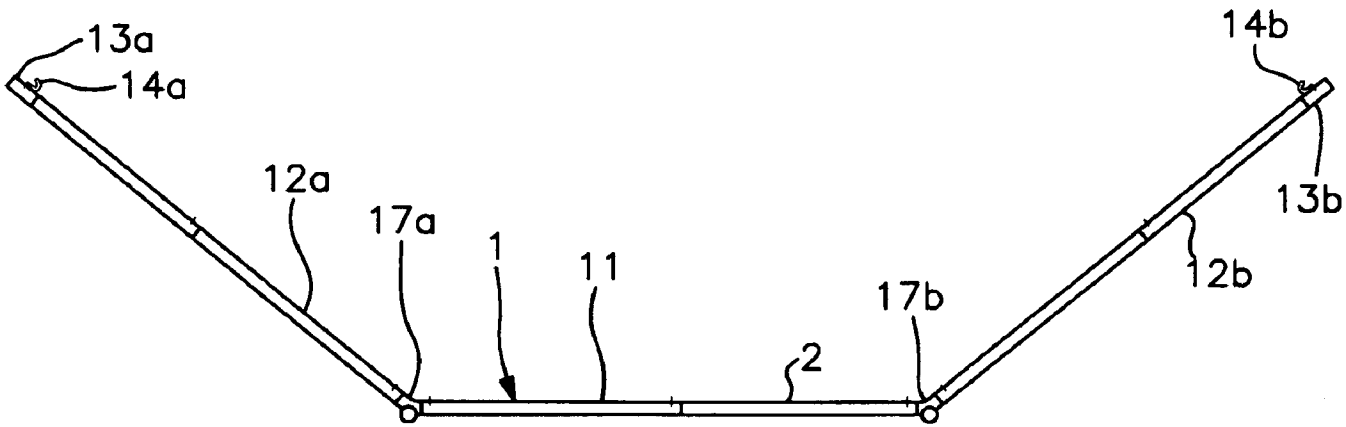
FIG. 4 is a side plan view of the assembled stand

FIGS. 3 and 4 illustrate the assembled hammock stand. It comprises a base member 11, having upwardly extended numbers 12*a* and 12*b* at its opposite ends. Base member 11, as well as upwardly extending members 12*a* and 12*b*, each is formed of joined and secured poles 1 and 2. On the upper ends of members 12*a* and 12*b*, are end caps 13*a* and 13*b*, which fit tightly over the upper ends of member 12*a* and 12*b*. Both end caps 13*a* and 13*b*, have support hooks 14*a* and 14*b*, to receive and support the terminal clew ring of a hammock extended between them. Foot members 15*a* and 15*b* extend laterally from opposite ends of base member 11. Opposite ends of foot members 15*a* and 15*b*, are covered by end caps 16*a*, 16*b*, 16*c* and 16*d*. Foot members 15*a* and 15*b* are joined to base member 11 and upward members 12*a* and 12*b* by elbow joints 17*a* and 17*b*.

Figure 5:
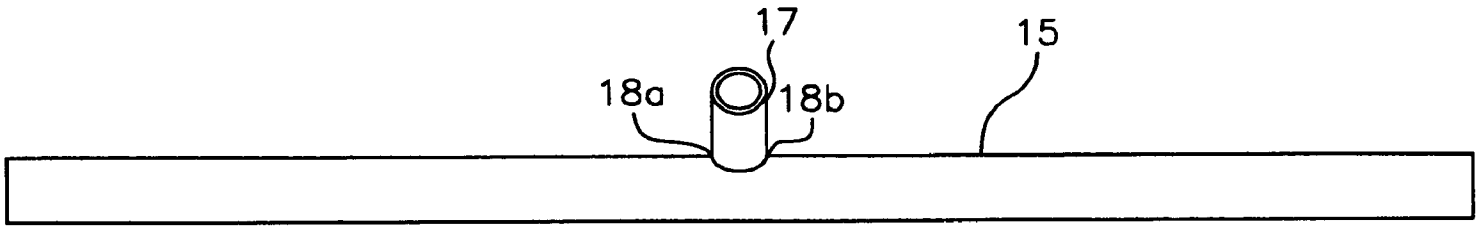
FIG. 5 is a front plan view of lateral foot member

Foot member 15 is illustrated in FIG. 5. Elbow joint 17 is permanently attached to foot member 15 by spot welds, 18*a* and 18*b*.

Figure 6:
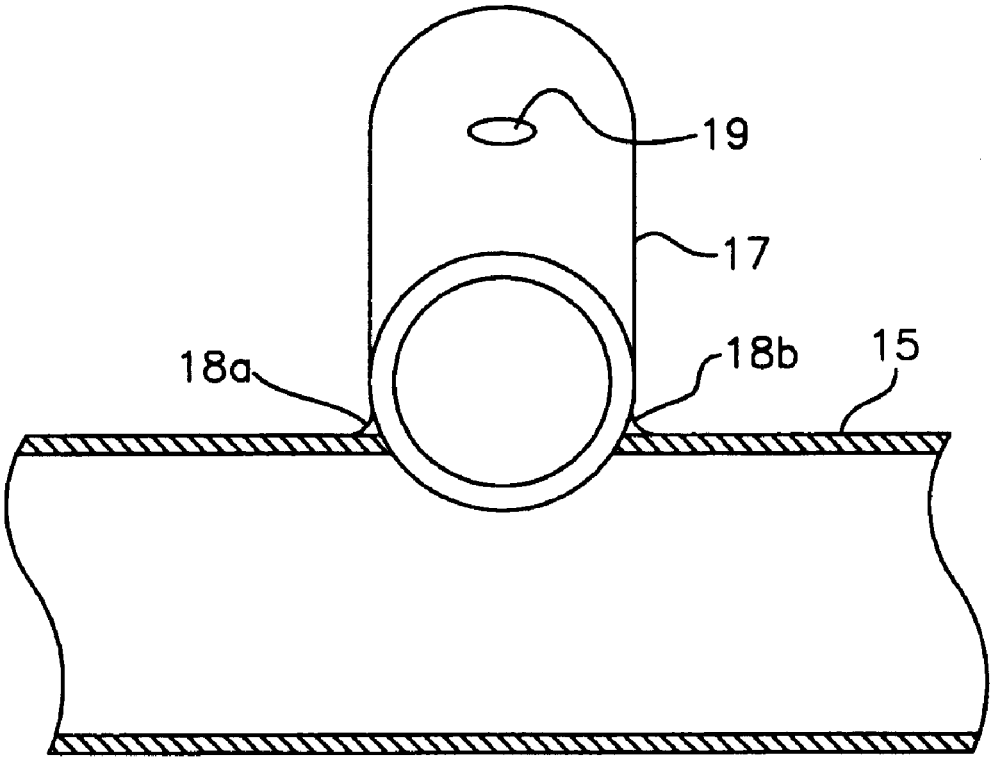
FIG. 6 is a cross sectional front view of the elbow joint as attached to the foot member
Figure 7:
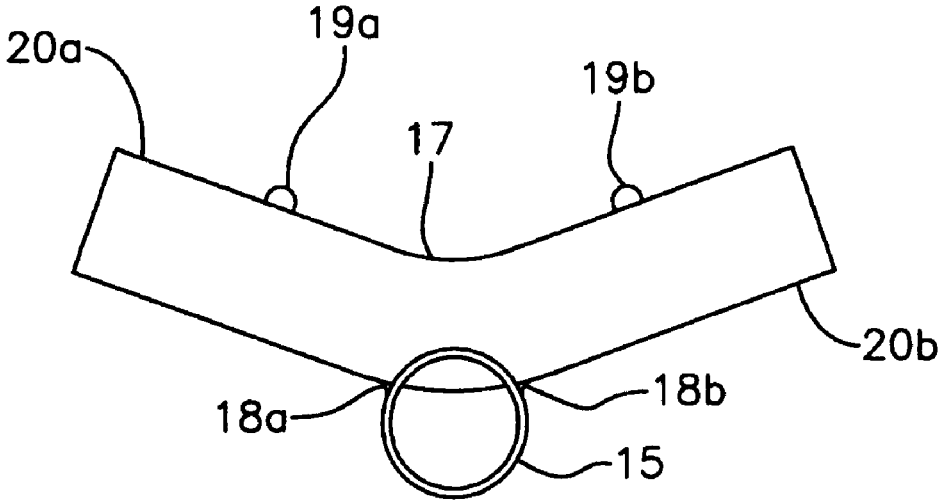
FIG. 7 is a cross sectional side view of the elbow joint as attached to the foot member

The elbow joint 17 is further illustrated in FIGS. 6 and 7. The elbow joint 17 has opposite end portions 20*a* and 20*b*. Through the upside wall of end portion 20*a*, extends the spring button 19*a*. Through the upside wall of end portion 20*b*, extends the spring button 19*b*. The spring buttons 19*a* and 19*b*, align with and engage the apertures 5 and 10 in poles 1 and 2, which comprise members 11, 12*a* and 12*b*.

It will be appreciated that when disassembled, the hammock stand comprises six relatively short poles 1 and 2, as well as two slightly larger foot members 15. So the entire disassembled stand can be packed into a relatively small storage and shipment container.

It will be further apparent to those skilled in the art that various modifications and variations can be made in the device and method of the present invention without departing from the spirit or scope of the invention. Thus, it is intended that the present invention cover the modifications and variations of this invention provided they come within the scope of the appended claims and their equivalents.

What is claimed is:

1. A stand for supporting a hammock comprising:

a horizontal base member and an upwardly extending member detachably connected to each end of said base member;

a foot member detachably connected to each end of said base member and extending laterally therefrom;

said base member and said upwardly extended members, each comprising at least two detachable connected tubular poles;

said tubular poles, all being of approximately the same dimension;

each set up connected poles comprising at least one straight pole and one swaged pole, the swaged pole having one circumferentially reduced end portion, the outer diameter of which is slightly less than the inner diameter of the straight pole;

each said circumferentially reduced end portion having an outwardly extending spring button which aligns with and engages a corresponding aperture in the connected straight pole.

* * * * *